US008408098B2

(12) United States Patent
Hu

(10) Patent No.: US 8,408,098 B2
(45) Date of Patent: Apr. 2, 2013

(54) RATCHET DEVICE

(76) Inventor: Bobby Hu, Taichung (TW)

( * ) Notice: Subject to any disclaimer, the term of this patent is extended or adjusted under 35 U.S.C. 154(b) by 380 days.

(21) Appl. No.: 12/904,228

(22) Filed: Oct. 14, 2010

(65) Prior Publication Data

US 2011/0126678 A1 Jun. 2, 2011

(30) Foreign Application Priority Data

Nov. 30, 2009 (TW) ..... 98140878 A

(51) Int. Cl.
*B25B 13/46* (2006.01)
*B25B 23/00* (2006.01)
*B25G 1/08* (2006.01)

(52) U.S. Cl. ..... 81/63.1; 81/177.4; 81/439

(58) Field of Classification Search ..... 81/60, 63.1, 81/177.4, 439
See application file for complete search history.

(56) References Cited

U.S. PATENT DOCUMENTS 6,148,696 A * 11/2000 Chiang ..... 81/60
8,272,298 B2 * 9/2012 Chen ..... 81/63.1
2009/0217789 A1 9/2009 Chang ..... 81/60
2011/0088519 A1 * 4/2011 Hu ..... 81/177.4

* cited by examiner

*Primary Examiner* — Hadi Shakeri
(74) *Attorney, Agent, or Firm* — Alan Kamrath; Kamrath IP Lawfirm, P.A.

(57) ABSTRACT

A ratchet device includes a body having a compartment extending along a first axis. A ratchet member is rotatably received in the compartment about the first axis. The body includes first and second sides each having a receptacle in communication with the compartment. A ratchet block is received in each receptacle. A control member is received in a groove in a top side of the body. The groove is in communication with the compartment via an opening. The control member is movable between three positions along an axis perpendicular to but spaced from the first axis to disengage a toothed portion of either of the ratchet blocks from teeth on the ratchet member so as to control the driving direction of the ratchet device.

15 Claims, 16 Drawing Sheets

RATCHET DEVICE

BACKGROUND OF THE INVENTION

The present invention relates to a ratchet device and, more particularly, to a ratchet device that controls a ratcheting direction by lateral movement of a control member.

U.S. Patent Publication No. US 2009/0217789 discloses a ratchet control structure including a socket, a twisting head, and a control ring. The socket includes inner ratchet teeth. A polygonal driving ring to be driven by a wrench or a sleeve is disposed above the socket. The twisting head includes a body engaged in the socket. A ball is biased by a spring received in a positioning hole in the body into one of a plurality of arced slots in the control ring. Two engagement blocks are pivotably mounted to the body for releasable engagement with the inner ratchet teeth. The control ring can be rotated to control positioning of the ball in one of the arced slots and to push one or both of the engagement blocks such that the ratchet control structure can drive an object in either of clockwise and counterclockwise directions. However, the control ring is liable to be inadvertently actuated while a user holds the socket during operation. The user has to move the control ring back to the desired position.

Thus, a need exists for a ratchet device without the risk of inadvertent actuation during use.

BRIEF SUMMARY OF THE INVENTION

The present invention solves this need and other problems in the field of reliable positioning of ratchet devices by providing, in a preferred form, a ratchet device including a body having a compartment extending along a first axis. The body further includes a receptacle extending along an axis parallel to and spaced from the first axis. The body further includes first and second sides delimiting the compartment. The first side includes a first receptacle defining a second axis and in communication with the compartment. The second side includes a second receptacle defining a third axis and in communication with the compartment. The second and third axes are parallel to each other and located on the same side of the first axis. The second and third axes are spaced from each other in a direction parallel to the first axis. Each of the second and third axes is spaced from the first axis in a radial direction perpendicular to the first axis. The first and second compartments are in communication with the same side of the compartment. The body further includes a top side extending between the first and second sides. The top side includes a groove in communication with the receptacle. The groove includes a bottom wall having an opening in communication with the compartment. A ratchet member is received in the compartment of the body and rotatable about the first axis. The ratchet member includes an outer periphery having a plurality of teeth. The ratchet member includes a driving hole. The driving hole is adapted to drive a fastener or a bit. A positioning unit is received in the receptacle of the body. A first ratcheting unit is received in the first receptacle of the first side and movable along the second axis. The first ratcheting unit includes a first ratchet block and a first elastic element for returning the first ratchet block. The first ratchet block includes a first toothed portion releasably engaged with the plurality of teeth of the ratchet member. A second ratcheting unit is received in the second receptacle of the second side and movable along the third axis. The second ratcheting unit includes a second ratchet block and a second elastic element for returning the second ratchet block. The second ratchet block includes a second toothed portion releasably engaged with the plurality of teeth of the ratchet member. A control member includes a first end received in the groove of the body. The control member further includes a second end extending through the opening of the body into the compartment. Either of the first and second ratchet blocks is movable by the second end of the control member to disengage either of the first and second toothed portions from the plurality of teeth of the ratchet member. The control member defines a fourth axis spaced from the first axis. The control member is movable between first, second, and third positions along the fourth axis. The positioning unit positions the control member in one of the first, second, and third positions.

When the control member is in the first position, the first and second toothed portions are engaged with the plurality of teeth of the ratchet member, and the ratchet member is not rotatable relative to the body.

When the control member is in the second position, the first toothed portion is engaged with the plurality of teeth of the ratchet member, and the second toothed portion is disengaged from the plurality of teeth of the ratchet member. The ratchet member is rotatable relative to the body in a first direction. The ratchet member and the body are jointly rotatable in a second direction reverse to the first direction.

When the control member is in the third position, the first toothed portion is disengaged from the plurality of teeth of the ratchet member, and the second toothed portion is engaged with the plurality of teeth of the ratchet member. The ratchet member is rotatable relative to the body in the second direction. The ratchet member and the body are jointly rotatable in the first direction.

In the most preferred form, the fourth axis is located intermediate the second and third axes and extends perpendicularly to the first axis. Each of the second and third axes is perpendicular to but spaced from the first axis. Each of the first and second ratchet blocks includes a first surface having an actuation groove and an actuation wall. The second end of the control member includes a driving arm extending into the actuation grooves. The actuation wall of each of the first and second ratchet blocks is actuatable by the driving arm to disengage either of the first and second toothed portions from the plurality of teeth of the ratchet member. The actuation wall of the first ratchet block is located adjacent to the first elastic element, and the actuation wall of the second ratchet block is located adjacent to the second elastic element. Each of the first and second ratchet blocks includes an arcuate second surface opposite to the first surface. The first toothed portion is formed on the second surface of the first ratchet block. The second toothed portion is formed on the second surface of the second ratchet block. Each of the first and second ratchet blocks includes a receiving hole. The receiving hole of the first ratchet block receives the first elastic element. The receiving hole of the second ratchet block receives the second elastic element. The first end of the control member includes two opposite lateral sides each forming an actuation portion. The control member further includes a longitudinal wall extending between the actuation portions. The longitudinal wall includes first, second, and third positioning grooves at the same level and spaced along the fourth axis. The positioning unit is selectively engaged with one of the first, second, and third positioning grooves to position the control member in one of the first, second, and third positions.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
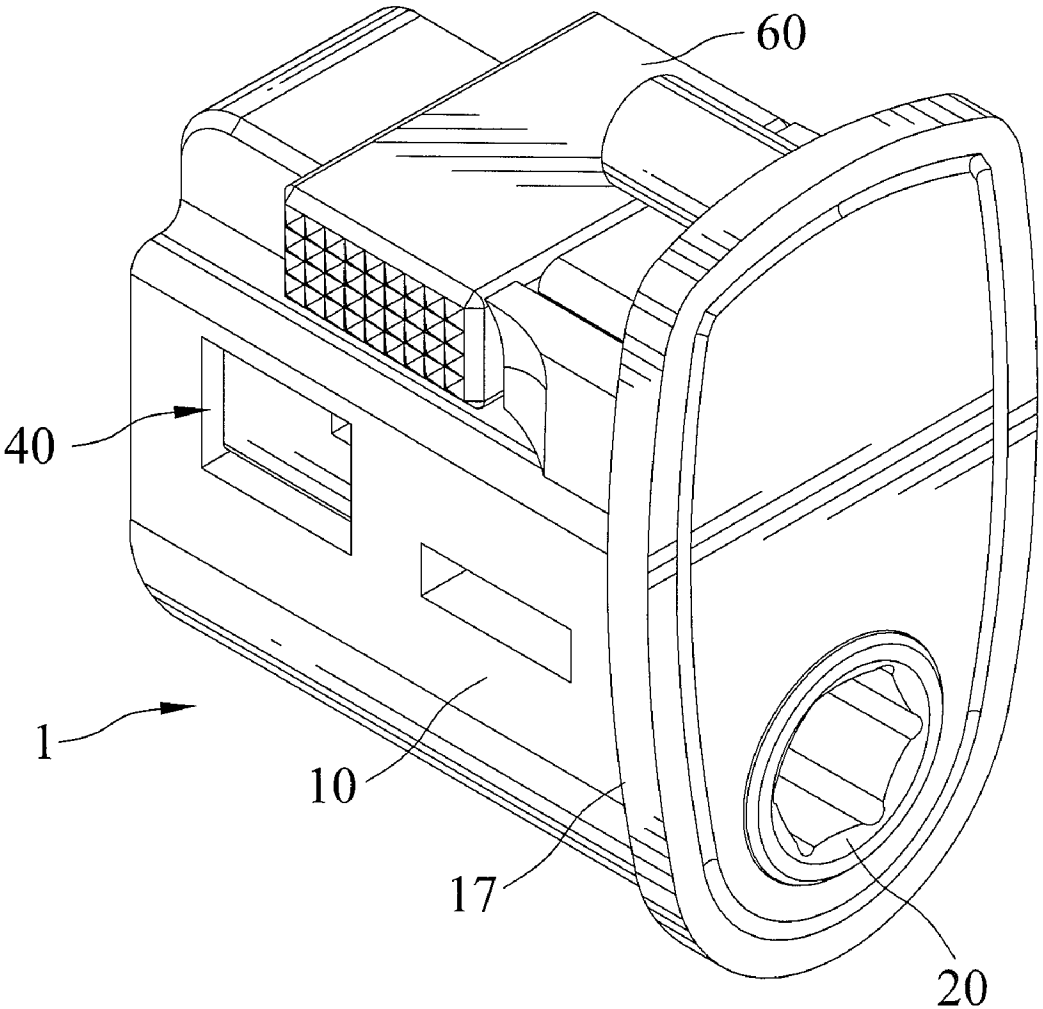
FIG. 1 shows a perspective view of a ratchet device according to the preferred teachings of the present invention.
Figure 2:
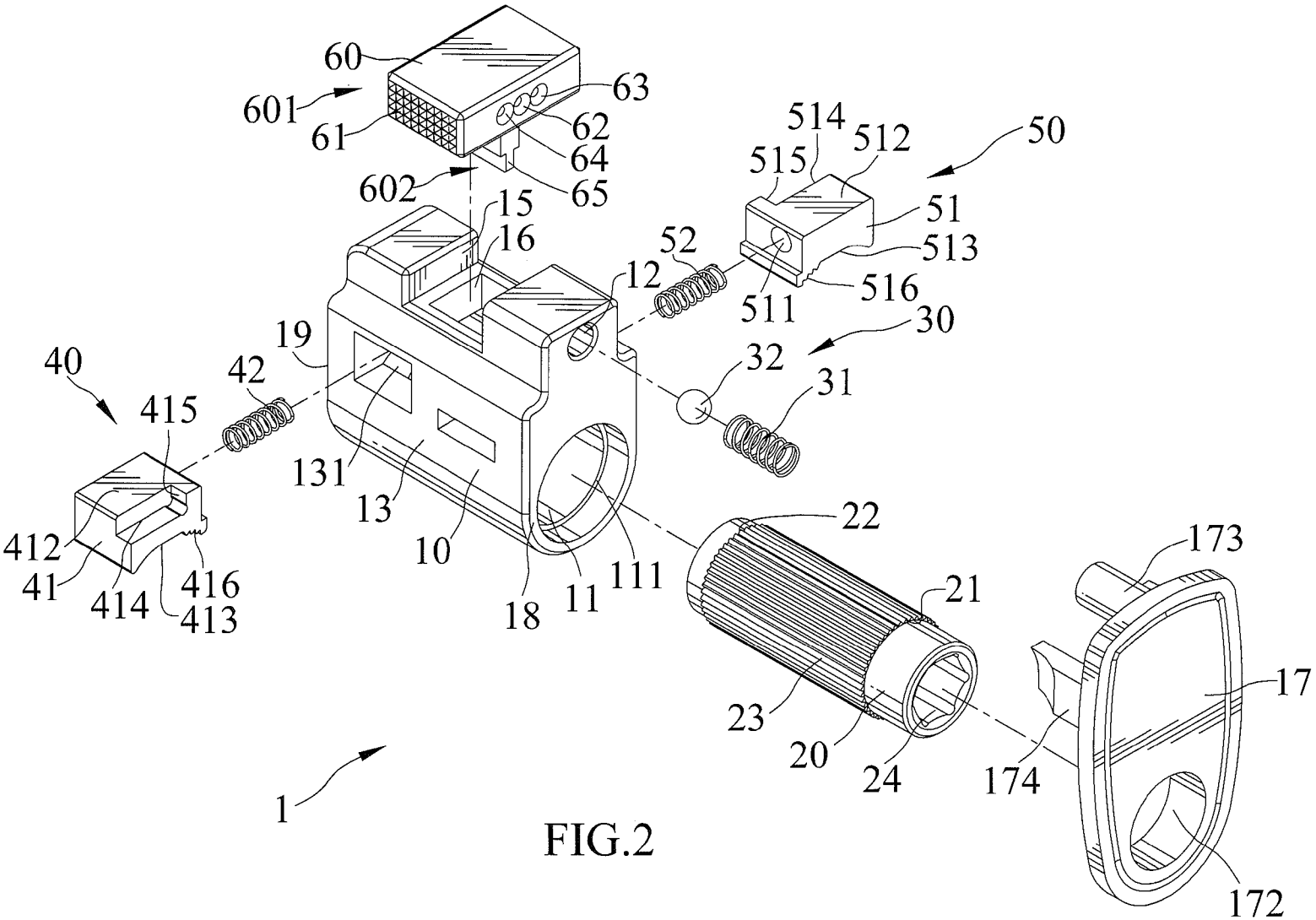
FIG. 2 shows an exploded, perspective view of the ratchet device of FIG. 1.
Figure 3:
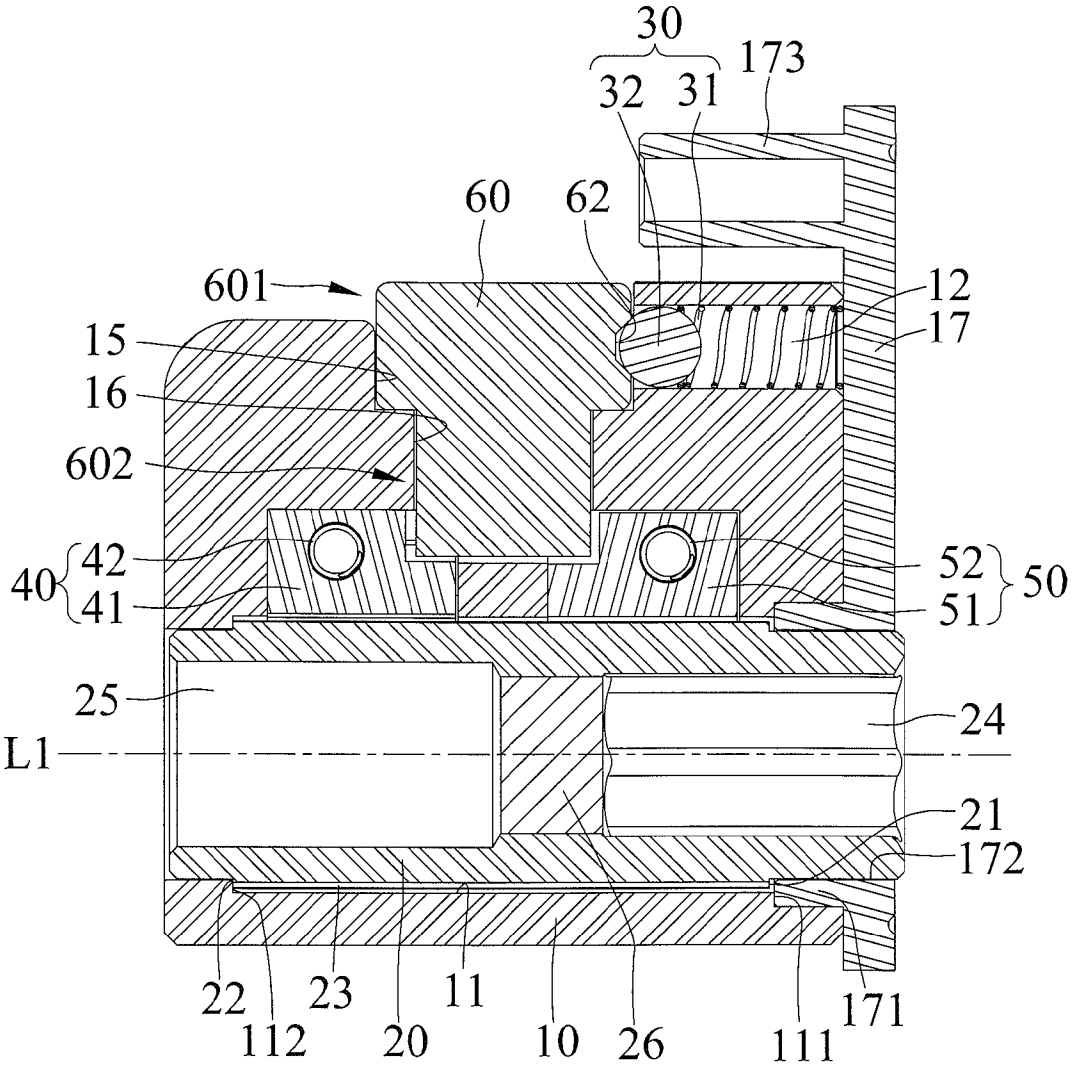
FIG. 3 shows a cross sectional view of the ratchet device of FIG. 1.
Figure 4:
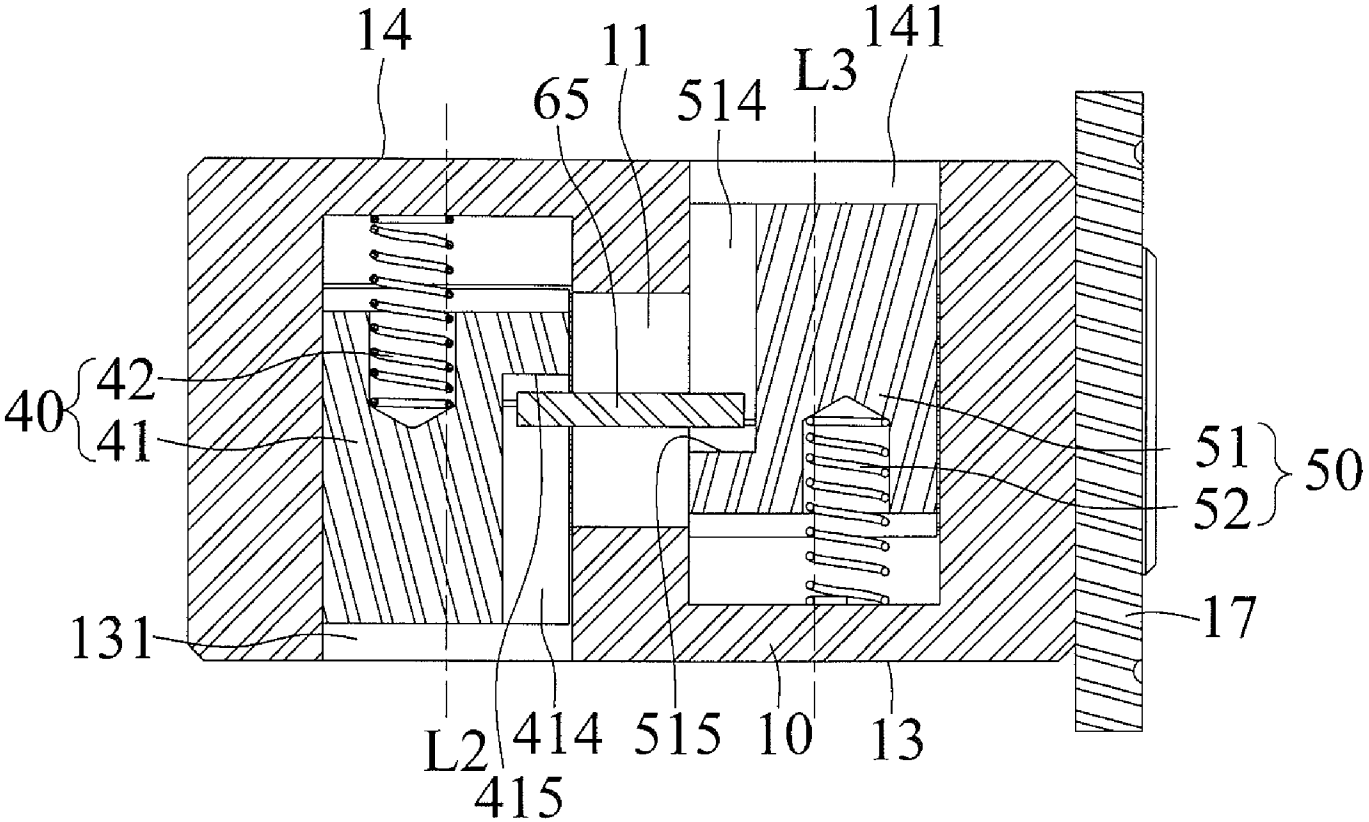
FIG. 4 shows another cross sectional view of the ratchet device of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "top", "inner", "outer", "side", "end", "portion", "longitudinal", "axial", "radial", "lateral", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A ratchet device according to the preferred teachings of the present invention is shown in the drawings and generally designated 1. According to the preferred form shown, ratchet device 1 includes a body 10, a ratchet member 20, a positioning unit 30, a first ratcheting unit 40, a second ratcheting unit 50, and a control member 60.

Body 10 includes a compartment 11 extending along a first axis L1 and a receptacle 12 extending along an axis parallel to and spaced from first axis L1 and compartment 11. In the most preferred form shown, compartment 11 extends from a first end 18 through a second end 19 of body 10 and includes decreasing diameters towards second end 19, forming first and second shoulders 111 and 112 respectively in first and second ends 18 and 19. Body 10 further includes first and second sides 13 and 14 extending between first and second ends 18 and 19 and delimiting compartment 11. First axis L1 is located intermediate first and second sides 13 and 14. First side 13 includes a first receptacle 131 in communication with compartment 11 and defining a second axis L2. Second side 14 includes a second receptacle 141 in communication with compartment 11 and defining a third axis L3. Second and third axes L2 and L3 are parallel to each other and spaced from each other in a direction parallel to first axis L1. Second and third axes L2 and L3 are on the same side of first axis L1. Each of second and third axes L2 and L3 is spaced from first axis L1 in a radial direction perpendicular to first axis L1. Thus, first and second receptacles 131 and 141 are in communication with the same side of compartment 11, and each of second and third axes L2 and L3 is perpendicular to but spaced from first axis L1.

Body 10 further includes a top side extending between first and second ends 18 and 19 and between first and second sides 13 and 14. The top side includes a groove 15. Groove 15 includes a bottom wall having an opening 16 in communication with compartment 11 and first and second receptacles 131 and 141. Furthermore, receptacle 12 is in communication with groove 15.

A cap 17 is mounted to first end 18 of body 10. Cap 17 includes a protrusion 171 on an end thereof. Protrusion 171 abuts first shoulder 111 and includes a through-hole 172 in communication with compartment 11. The other end of cap 17 includes a peg 173 and two abutment portions 174 on opposite sides of peg 173.

Ratchet member 20 is received in compartment 11 of body 10 and rotatable about first axis L1. First and second stops 21 and 22 are formed on first and second ends of an outer periphery of ratchet member 20. A plurality of teeth 23 is formed between the first and second ends of the outer periphery of ratchet member 20. An axially extending driving hole 24 is defined in the first end of ratchet member 20 and has hexagonal cross sections for driving a fastener or a bit. A receiving hole 25 is formed in the second end of ratchet member 20 for receiving fasteners or bits. A magnetic member 26 is mounted between driving hole 24 and receiving hole 25 for attracting the fastener or the bit. First stop 21 corresponds to first shoulder 111, and second stop 22 abuts second shoulder 112. Furthermore, protrusion 171 abuts first stop 21. Thus, ratchet member 20 is restrained between protrusion 171 and second shoulder 112, avoiding disengagement of ratchet member 20 from body 10.

Positioning unit 30 is mounted in receptacle 12 and includes an elastic element 31 and a ball 32 in the most preferred form shown. Elastic element 31 is mounted between cap 17 and ball 32, biasing ball 32 to partially protrude into groove 15.

First ratcheting unit 40 is received in first receptacle 131 and movable along second axis L2. First ratcheting unit 40 includes a first ratchet block 41 and a first elastic element 42. First ratchet block 41 includes a receiving hole 411 receiving first elastic element 42 for returning first ratchet block 41. First ratchet block 41 includes opposite first and second surfaces 412 and 413. First surface 412 includes an actuation groove 414 and an actuation wall 415 adjacent first elastic element 42. Second surface 413 is arcuate and includes a toothed portion 416 on an end thereof adjacent first elastic element 42. Toothed portion 416 of second surface 413 faces and is selectively engaged with teeth 23 of ratchet member 20.

Second ratcheting unit 50 is received in second receptacle 141 and movable along third axis L3. Second ratcheting unit 50 includes a second ratchet block 51 and a second elastic element 52. Second ratchet block 51 includes a receiving hole 511 receiving second elastic element 52 for returning second ratchet block 51. Second ratchet block 51 includes opposite first and second surfaces 512 and 513. First surface 512 includes an actuation groove 514 and an actuation wall 515 adjacent second elastic element 52. Second surface 513 is arcuate and includes a toothed portion 516 on an end thereof adjacent second elastic element 52. Toothed portion 516 of second surface 513 faces and is selectively engaged with teeth 23 of ratchet member 20.

Control member 60 is received in groove 15 and opening 16 of body 10 and extends into actuation groove 414 and 514 of first and second ratchet blocks 41 and 51. Control member 60 defines a fourth axis L4 perpendicular to but spaced from first axis L1. Fourth axis L4 is intermediate second and third axes L2 and L3 along first axis L1. Control member 60 is movable along fourth axis L4 between first, second, and third positions and positionable by positioning unit 30. Control member 60 includes first and second ends 601 and 602. First end 601 of control member 60 includes two opposite lateral sides each forming an actuation portion 61 that has knurls to provide anti-slipping effect to fingers of a user. First, second, and third positioning grooves 62, 63, and 64 are formed in a longitudinal wall extending between actuation portions 61. First, second, and third positioning grooves 62, 63, and 64 are at the same level and spaced along fourth axis L4 along first axis L1. Second end 602 of control member 60 has a driving arm 65. First end 601 of control member 60 is received in groove 15 of body 10. Positioning unit 30 is aligned with one of first, second, and third positioning grooves 62, 63, and 64. Driving arm 65 is extended through opening 16 of body 10 into actuation grooves 414 and 415 of first and second ratchet blocks 41 and 51 and can actuate either of first and second ratchet blocks 41 and 51 by actuation wall 415, 515.

Figure 6:
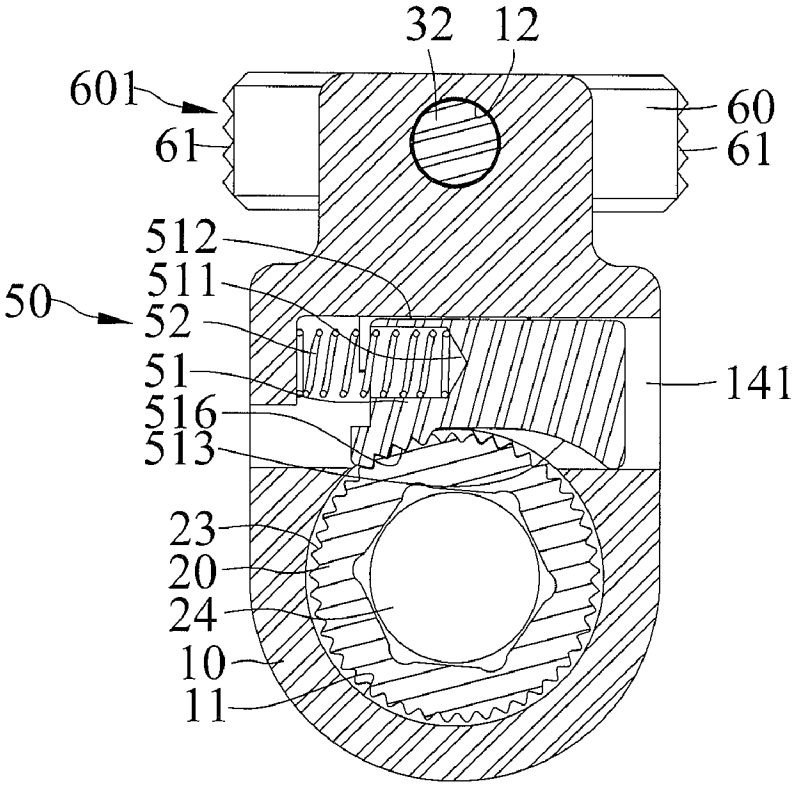
FIG. 6 shows a cross sectional view of the ratchet device of FIG. 1, illustrating engagement of a second ratchet block with the ratchet member.
Figure 5:
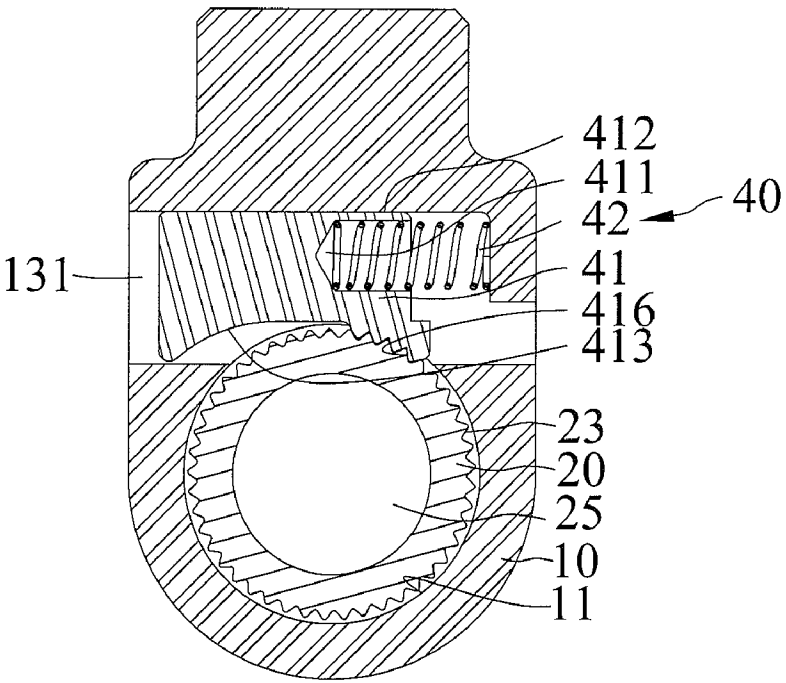
FIG. 5 shows another cross sectional view of the ratchet device of FIG. 1, illustrating engagement of a first ratchet block with a ratchet member.
Figure 7:
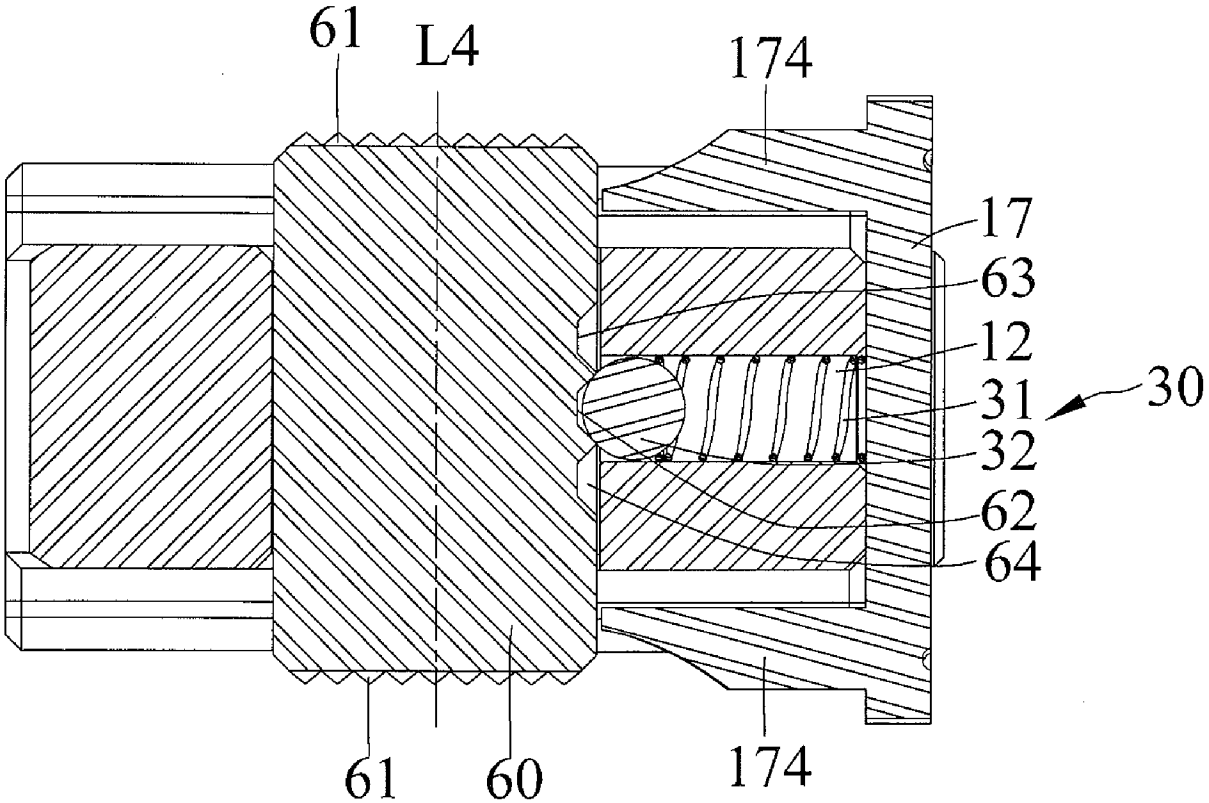
FIG. 7 shows a cross sectional view of the ratchet device of FIG. 1 with a control member in a first position.
Figure 8:
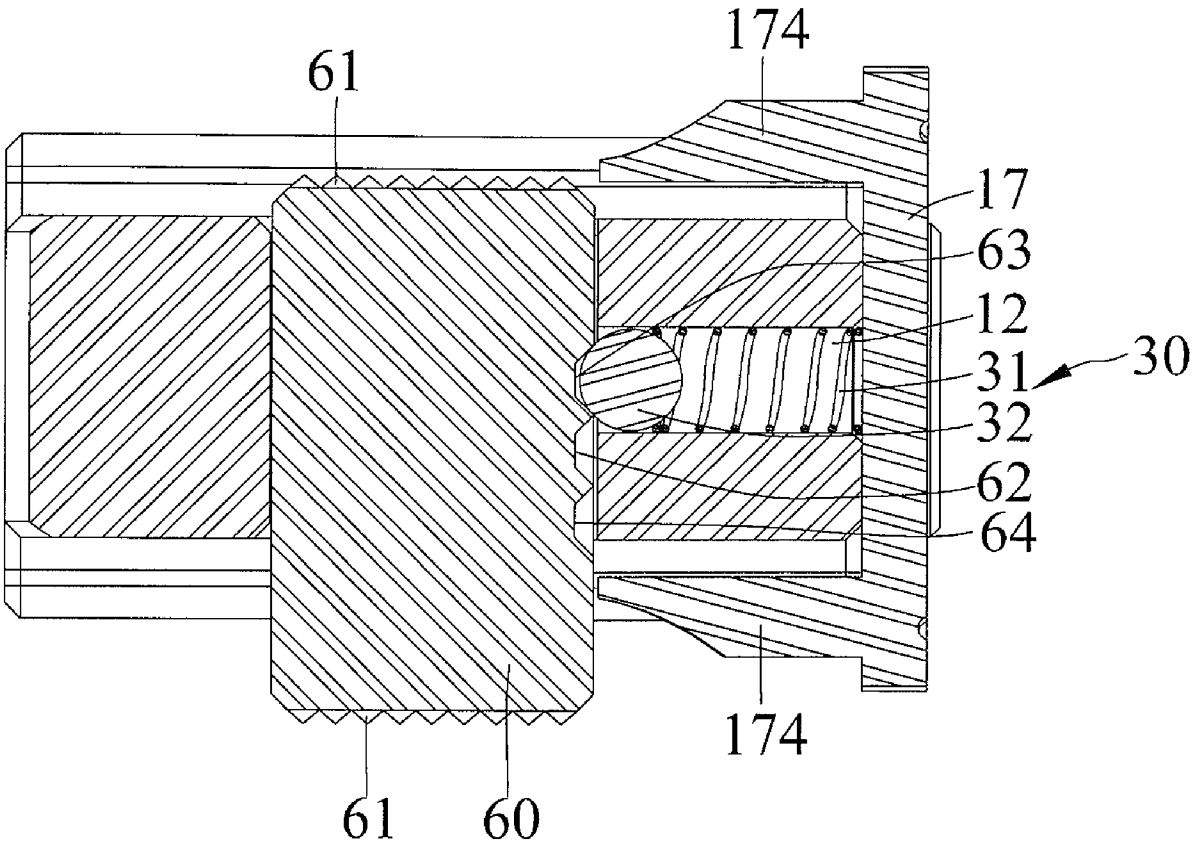
FIG. 8 shows a cross sectional view of the ratchet device of FIG. 1 with the control member in a second position.
Figure 9:
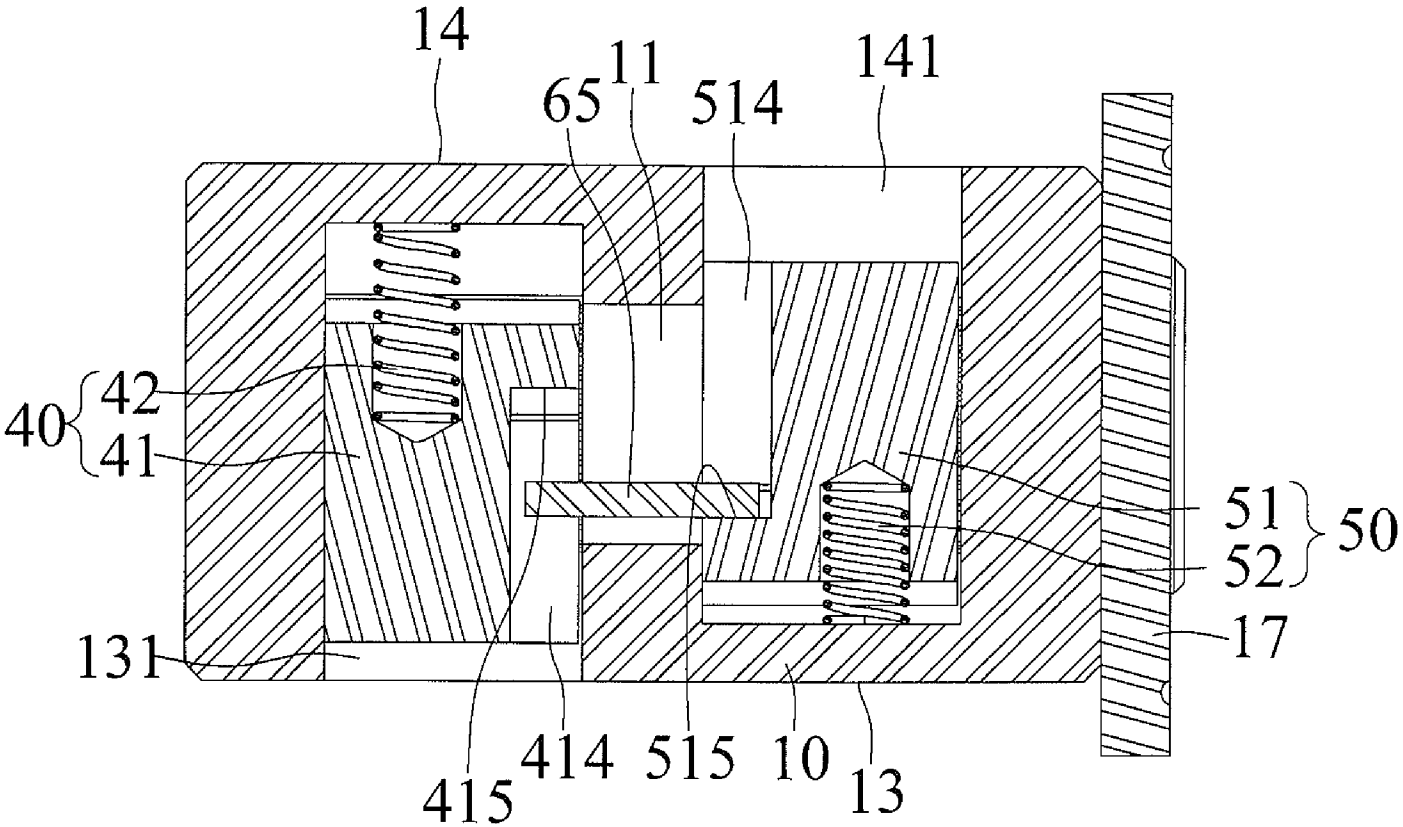
FIG. 9 shows a cross sectional view similar to FIG. 4 with the second ratchet block moved.
Figure 10:
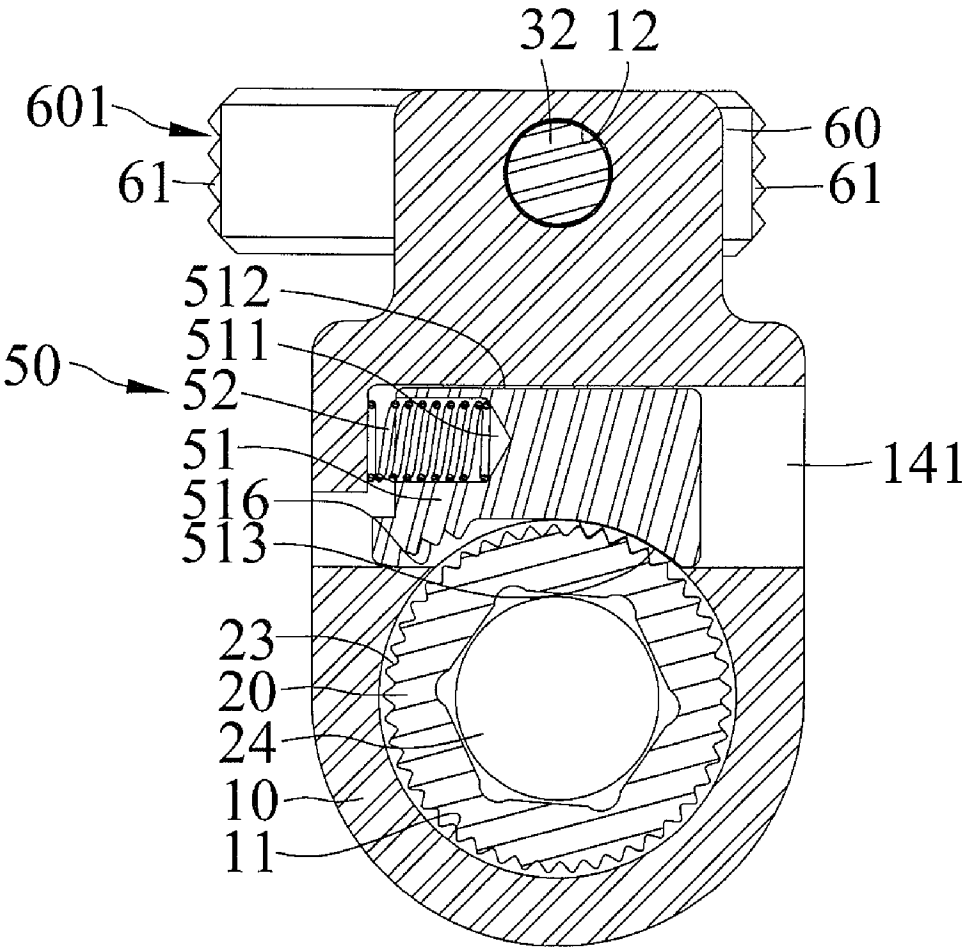
FIG. 10 shows a cross sectional view similar to FIG. 6 with the second ratchet block moved away from the ratchet member.
Figure 12:
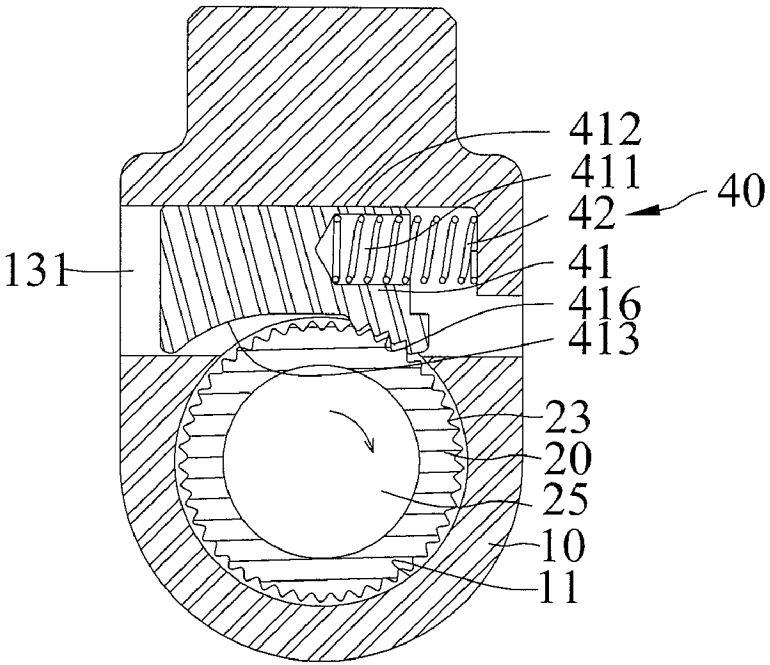
FIG. 12 shows a cross sectional view similar to FIG. 5, illustrating jumping of the first ratchet block engaged with the ratchet member while the ratchet device is rotated in the non-driving direction without driving an object.
Figure 11:
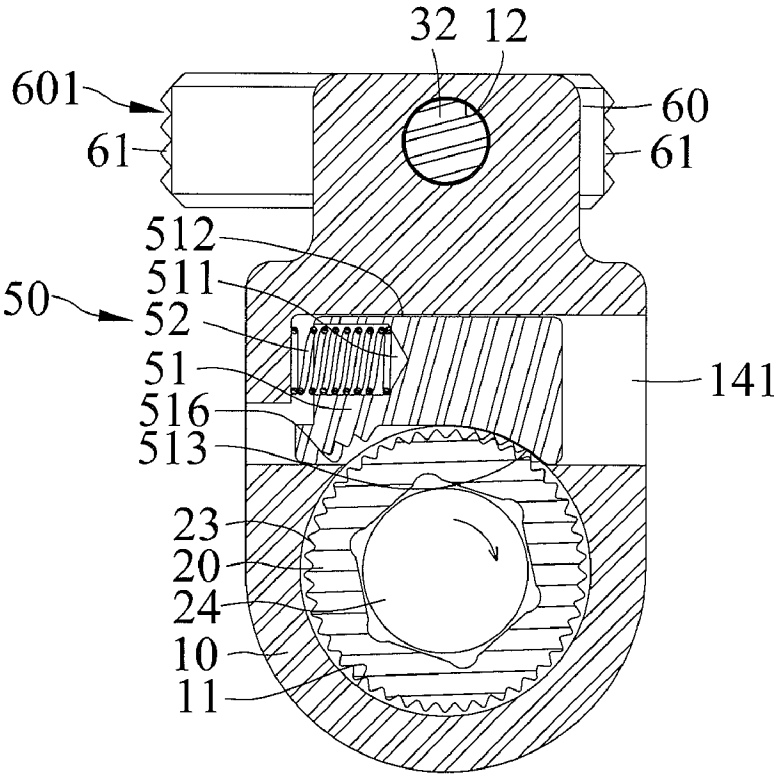
FIG. 11 shows a cross sectional view similar to FIG. 10, illustrating jumping of the first ratchet block engaged with the ratchet member while the ratchet device is rotated in a non-driving direction without driving an object.
Figure 13:
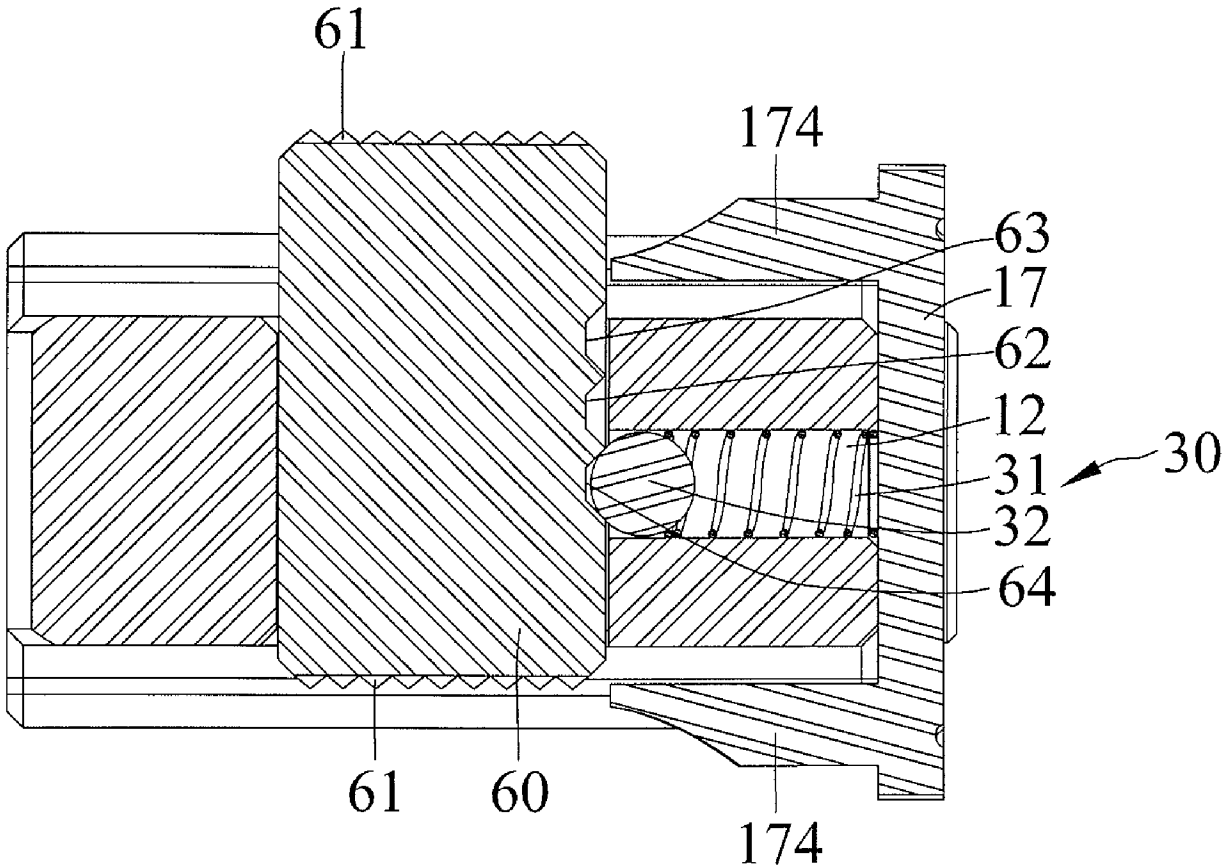
FIG. 13 shows a cross sectional view of the ratchet device of FIG. 1 with the control member in a third position.
Figure 14:
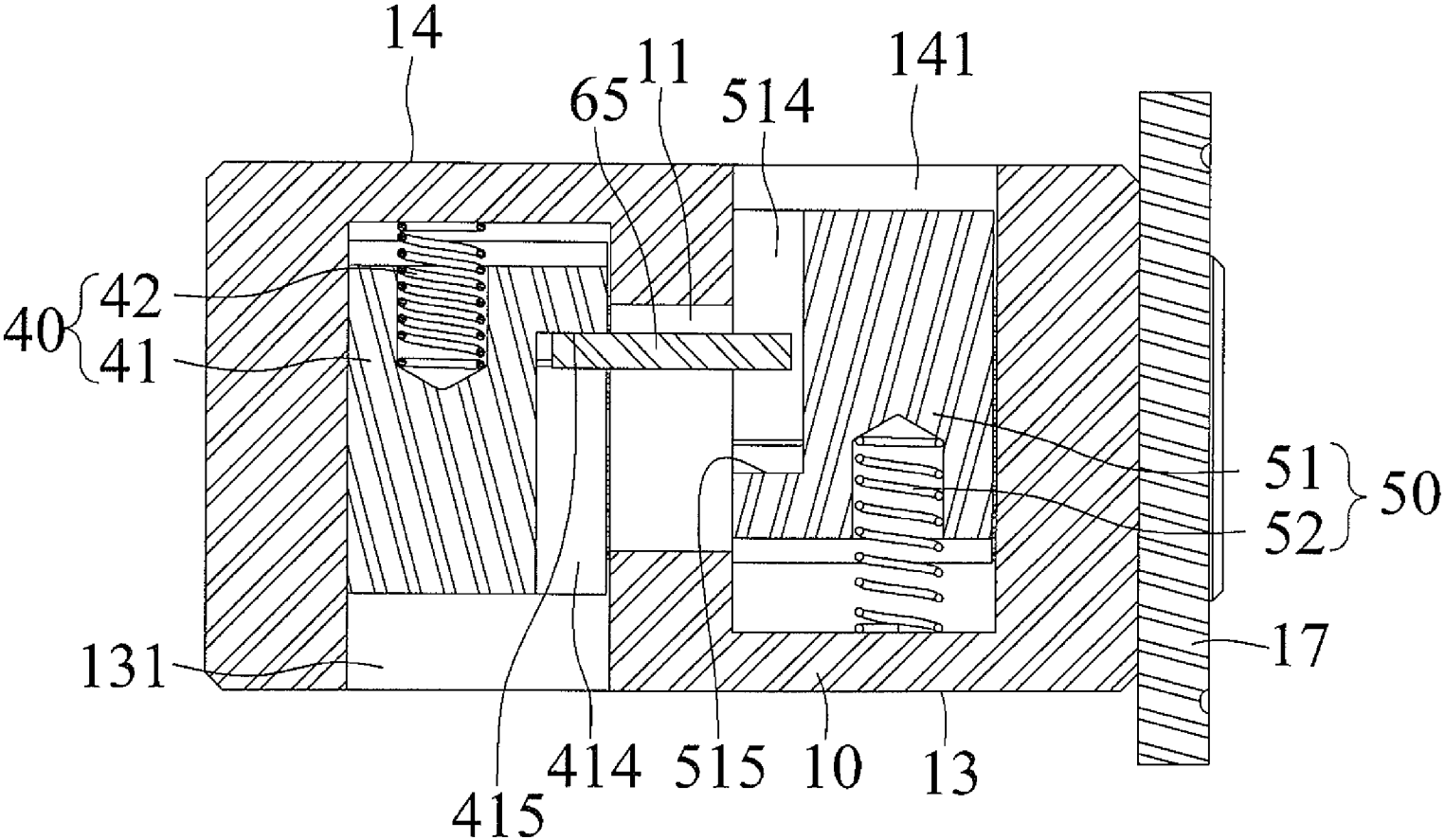
FIG. 14 shows a cross sectional view similar to FIG. 4 with the first ratchet block moved.
Figure 16:
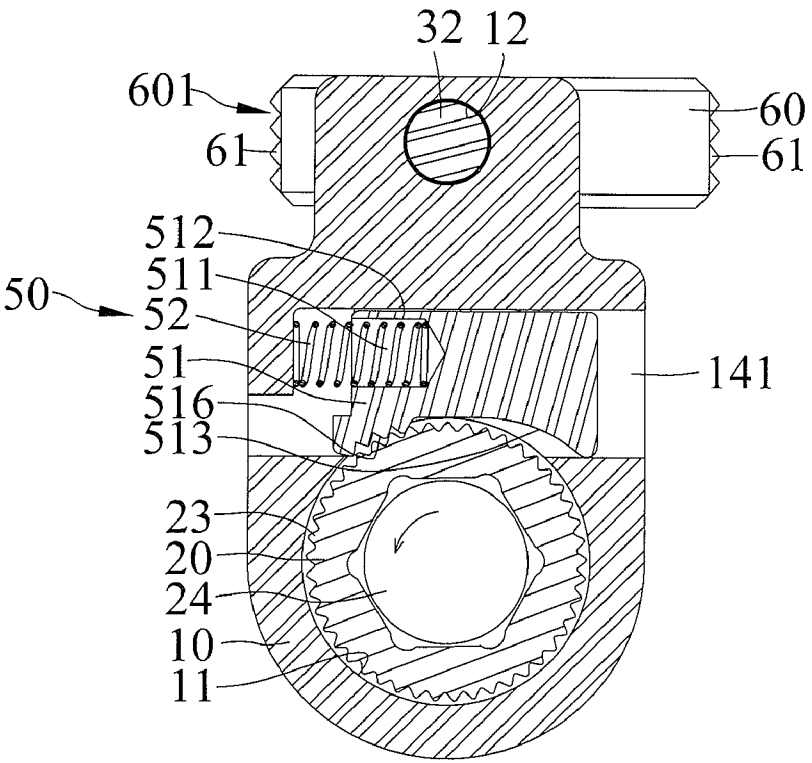
FIG. 16 shows a cross sectional view similar to FIG. 15, illustrating jumping of the second ratchet block engaged with the ratchet member while the ratchet device is rotated in a non-driving direction without driving an object.
Figure 15:
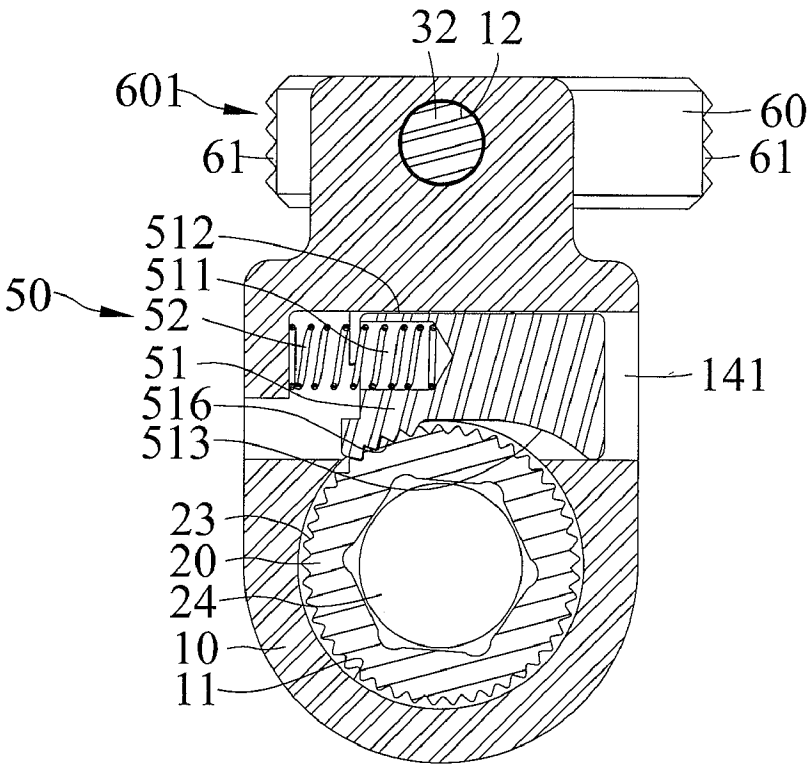
FIG. 15 shows a cross sectional view similar to FIG. 10, illustrating engagement of the second ratchet block and the ratchet member.
Figure 17:
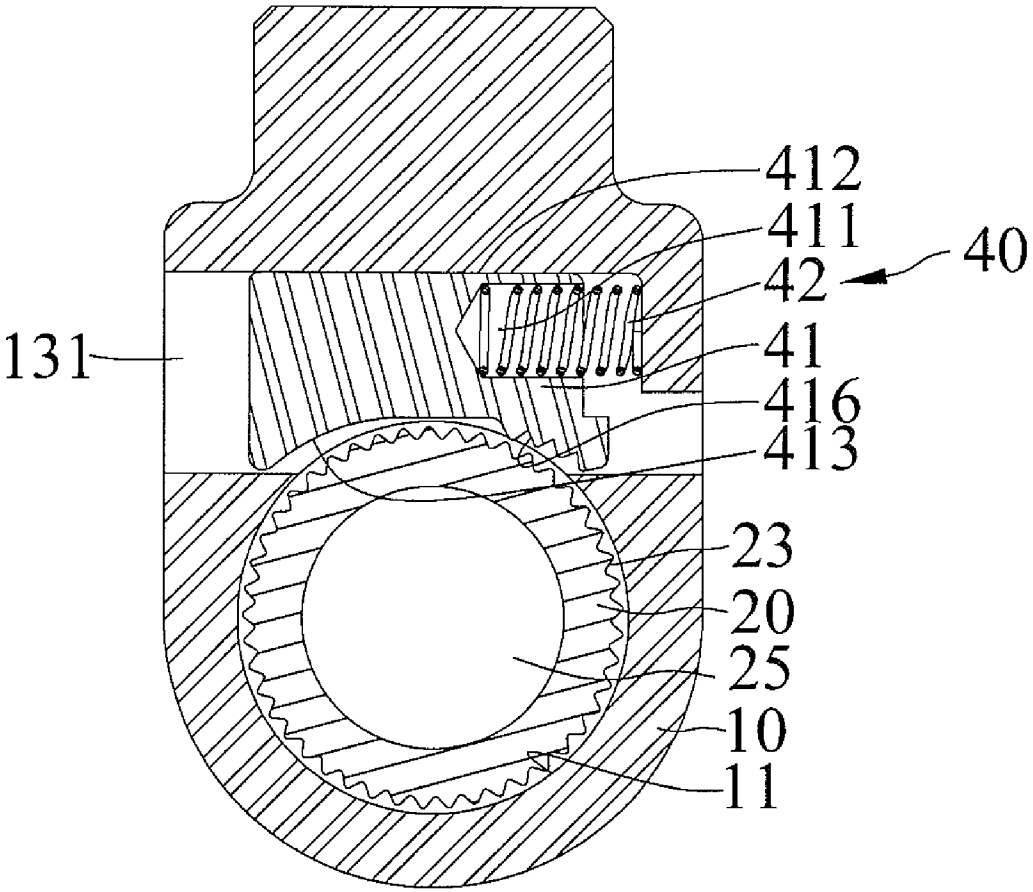
FIG. 17 shows a cross sectional view similar to FIG. 12, illustrating movement of the first ratchet block away from the ratchet member.
Figure 18:
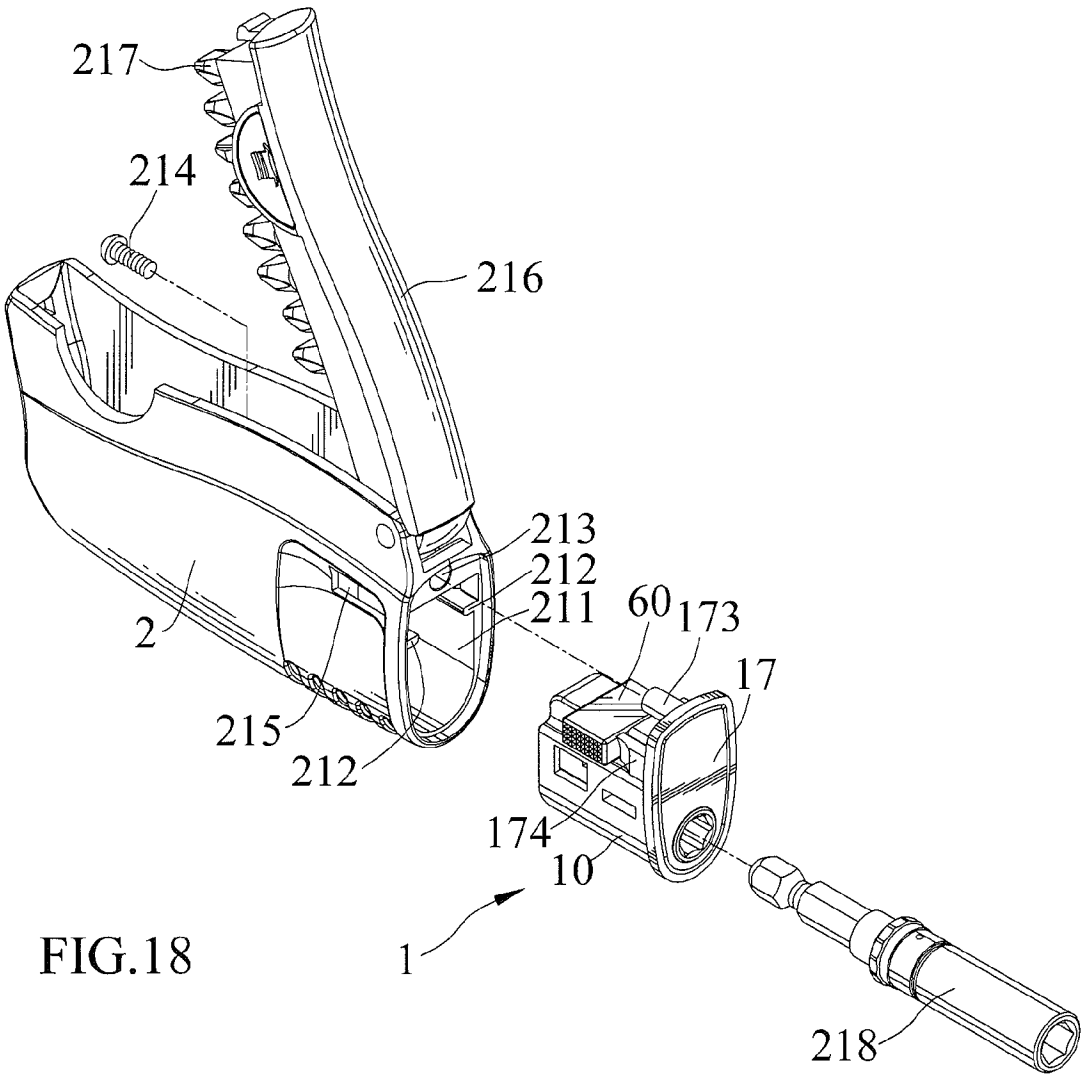
FIG. 18 shows an exploded, perspective view illustrating use of the ratchet device according to the preferred teachings of the present invention with a handle and a tool coupler.
Figure 19:
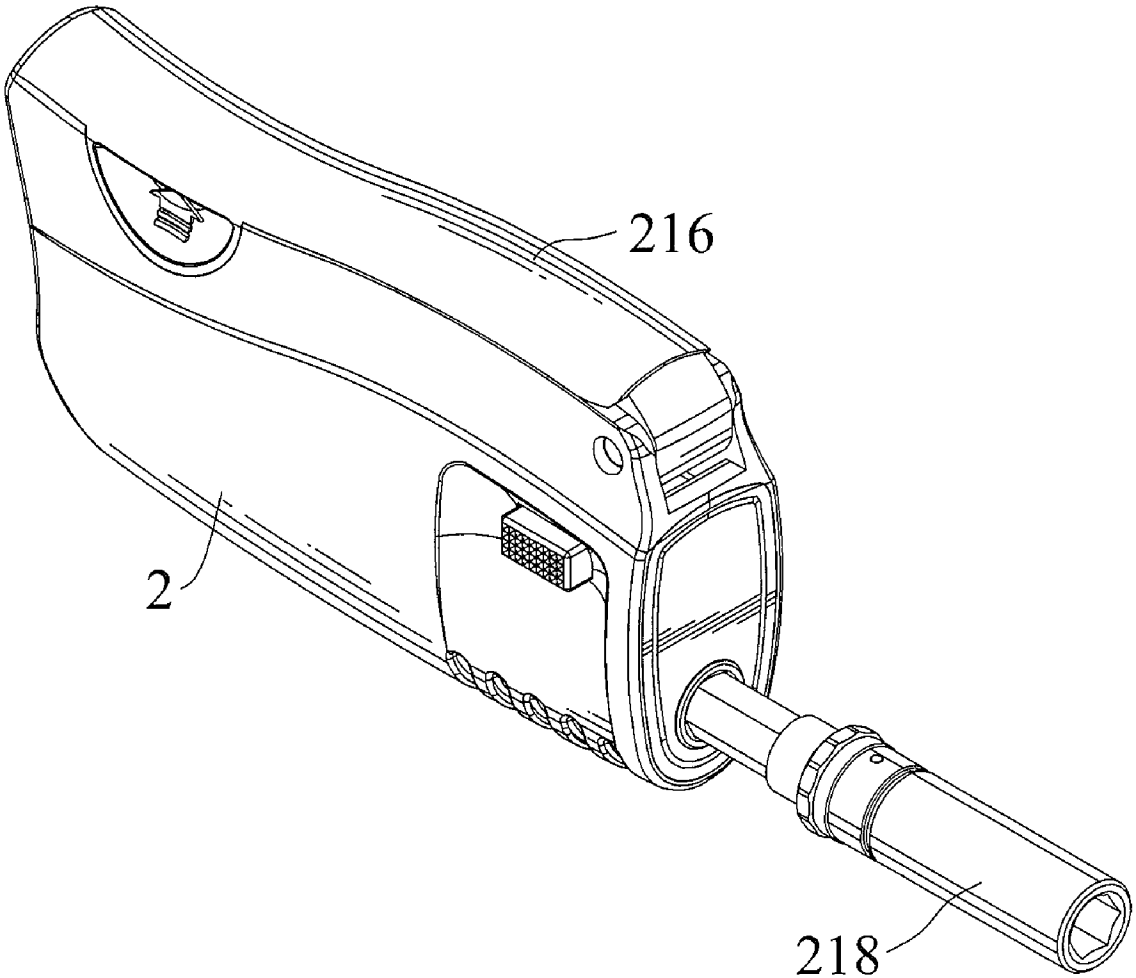
FIG. 19 shows a perspective of the ratchet device, the handle, and the tool coupler of FIG. 18 after assembly.

When control member 60 is in the first position shown in FIG. 7, first positioning groove 62 is aligned and engaged with ball 32 under the action of elastic element 31. With reference to FIGS. 5 and 6, first and second ratchet blocks 41 and 42 are biased by first and second elastic elements 42 and 52 such that toothed portions 416 and 516 simultaneously engage with teeth 23 of ratchet member 20. Ratchet member 20 can not rotate relative to body 10 about first axis L1. Ratchet member 20 is, thus, locked.

When control member 60 is moved from the first position to the second position shown in FIGS. 8-12 by pushing actuation portion 61 at first end 601 of control member 60, ball 32 engages with second positioning groove 63 under the action of elastic element 31. Driving arm 65 actuates actuation wall 515 of second ratchet block 51, moving toothed portion 516 away from teeth 23 of ratchet member 20. Toothed portion 416 of second ratchet block 41 is still engaged with teeth 23 of ratchet member 20. In this case, ratchet member 20 can only rotate relative to body 10 in a first direction. Ratchet member 20 can rotate jointly with body 10 in a second direction reverse to the first direction.

When control member 60 is moved from the first position to the third position shown in FIGS. 13-17 by pushing actuation portion 61 at first end 601 of control member 60, ball 32 engages with third positioning groove 64 under the action of elastic element 31. Driving arm 65 actuates actuation wall 415 of first ratchet block 41, moving toothed portion 416 away from teeth 23 of ratchet member 20. Toothed portion 516 of second ratchet block 51 is still engaged with teeth 23 of ratchet member 20. In this case, ratchet member 20 can only rotate relative to body 10 in the second direction. Ratchet member 20 can rotate jointly with body 10 in the first direction.

Since control member 60 controlling the driving direction of ratchet device 1 is moved along fourth axis L4, inadvertent actuation of control member 60 during use is less likely to occur, providing reliable positioning effect.

Ratchet device 1 according to the preferred teachings of the present invention can be used with a handle 2 or mounted in a tool box. Handle 2 includes a space 211 having two ribs 212 on two opposite walls of space 211. A through-hole 213 is defined in handle 2 adjacent to space 211 and receives a fastener 214. Handle 2 further includes two windows 215 in communication with space 211. A receiving portion 216 is pivotably connected to handle 2 and holds a plurality of bits 217. A tool coupler 218 can be received in space 211 of handle 2 or receiving hole 25 of ratchet member 20 when not in use.

In separate use, cap 17 is fixed to first end 18 of body 10, and driving hole 24 of ratchet member 20 can be used to drive a fastener or a bit 217 by directly holding and rotating body 10.

In use with handle 2, body 10 is received in space 211 with abutment portions 174 abutting ribs 212, with peg 173 extending through through-hole 213 and engaged with fastener 214, and with control member 60 accessible through windows 215 for manual operation. Tool coupler 18 can be inserted into driving hole 24 of body 10.

Cap 17 can be fixed to body 10 by other suitable provisions such as bonding. Furthermore, ratchet device 1 according to the preferred teachings of the present invention can be engaged in space 211 by tight-fitting.

Conclusively, ratchet device 1 according to the preferred teachings of the present invention provides reliable positioning effect without the risk of inadvertent actuation of control member 60, because control member 60 can only be moved along fourth axis L4. Furthermore, either of first and second ratchet blocks 41 and 42 can be reliably actuated by driving arm 65 of control member 60 due to provision of actuation wall 415, 515, providing reliable switching between the first, second, and third positions. Ratchet device 1 according to the preferred teachings of the present invention can be mounted in a handle 2 or a tool box. Further, ratchet device 1 according to the preferred teachings of the present invention can be use separately or together with a handle 2.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet device comprising, in combination:

a body including a compartment extending along a first axis, with the body further including a receptacle extending along an axis parallel to and spaced from the first axis, with the body further including first and second sides delimiting the compartment, with the first side including a first receptacle defining a second axis and in communication with the compartment, with the second side including a second receptacle defining a third axis and in communication with the compartment, with the second and third axes parallel to each other and located on a same side of the first axis, with the second and third axes spaced from each other in a direction parallel to the first axis, with each of the second and third axes spaced from the first axis in a radial direction perpendicular to the first axis, with the first and second compartments in communication with a same side of the compartment, with the body further including a top side extending between the first and second sides, with the top side including a groove in communication with the receptacle, with the groove including a bottom wall having an opening in communication with the compartment;

a ratchet member received in the compartment of the body and rotatable about the first axis, with the ratchet member including an outer periphery having a plurality of teeth, with the ratchet member including a driving hole, with the driving hole adapted to drive a fastener or a bit;

a positioning unit received in the receptacle of the body;

a first ratcheting unit received in the first receptacle of the first side and movable along the second axis, with the first ratcheting unit including a first ratchet block and a first elastic element for returning the first ratchet block, with the first ratchet block including a first toothed portion releasably engaged with the plurality of teeth of the ratchet member;

a second ratcheting unit received in the second receptacle of the second side and movable along the third axis, with the second ratcheting unit including a second ratchet block and a second elastic element for returning the second ratchet block, with the second ratchet block including a second toothed portion releasably engaged with the plurality of teeth of the ratchet member;

a control member including a first end received in the groove of the body, with the control member further including a second end extending through the opening of the body into the compartment, with either of the first and second ratchet blocks movable by the second end of the control member to disengage either of the first and second toothed portions from the plurality of teeth of the ratchet member, with the control member defining a fourth axis spaced from the first axis, with the control member movable between first, second, and third positions along the fourth axis, with the positioning unit positioning the control member in one of the first, second, and third positions, wherein when the control member is in the first position, the first and second toothed portions are engaged with the plurality of teeth of the ratchet member, the ratchet member is not rotatable relative to the body, wherein when the control member is in the second position, the first toothed portion is engaged with the plurality of teeth of the ratchet member, the second toothed portion is disengaged from the plurality of teeth of the ratchet member, the ratchet member is rotatable relative to the body in a first direction, the ratchet member and the body are jointly rotatable in a second direction reverse to the first direction, and wherein when the control member is in the third position, the first toothed portion is disengaged from the plurality of teeth of the ratchet member, the second toothed portion is engaged with the plurality of teeth of the ratchet member, the ratchet member is rotatable relative to the body in the second direction, the ratchet member and the body are jointly rotatable in the first direction.

2. The ratchet device as claimed in claim 1, with the fourth axis located intermediate the second and third axes and extending perpendicularly to the first axis.

3. The ratchet device as claimed in claim 1, with each of the second and third axes perpendicular to but spaced from the first axis.

4. The ratchet device as claimed in claim 1, with each of the first and second ratchet blocks including a first surface having an actuation groove and an actuation wall, with the second end of the control member including a driving arm extending into the actuation grooves, with the actuation wall of each of the first and second ratchet blocks actuatable by the driving arm to disengage either of the first and second toothed portions from the plurality of teeth of the ratchet member.

5. The ratchet device as claimed in claim 4, with the actuation wall of the first ratchet block located adjacent to the first elastic element, with the actuation wall of the second ratchet block located adjacent to the second elastic element, with each of the first and second ratchet blocks including an arcuate second surface opposite to the first surface, with the first toothed portion formed on the second surface of the first ratchet block, with the second toothed portion formed on the second surface of the second ratchet block.

6. The ratchet device as claimed in claim 1, with each of the first and second ratchet blocks including a receiving hole, with the receiving hole of the first ratchet block receiving the first elastic element, with the receiving hole of the second ratchet block receiving the second elastic element.

7. The ratchet device as claimed in claim 1, with the first end of the control member including two opposite lateral sides each forming an actuation portion.

8. The ratchet device as claimed in claim 7, with each of the actuation portions of the control member including knurls.

9. The ratchet device as claimed in claim 7, with the control member further including a longitudinal wall extending between the actuation portions, with the longitudinal wall including first, second, and third positioning grooves at a same level and spaced along the fourth axis, with the positioning unit selectively engaged with one of the first, second, and third positioning grooves to position the control member in one of the first, second, and third positions.

10. The ratchet device as claimed in claim 9, with the positioning unit including an elastic element and a ball biased by the elastic element to protrude into the groove and to engage with one of the first, second, and third positioning grooves.

11. The ratchet device as claimed in claim 1, with the driving hole formed in an end of the ratchet member, with the ratchet member further including another end having a receiving hole, with the receiving hole adapted to receive a bit.

12. The ratchet device as claimed in claim 11, further comprising, in combination: a magnetic member mounted between the driving hole and the receiving hole, with the magnetic member adapted to attract the bit received in the receiving hole.

13. The ratchet device as claimed in claim 1, with the compartment including first and second ends spaced along the first axis, with the compartment including first and second shoulders respectively in the first and second ends thereof, with the outer periphery of the ratchet member including first and second stops, with a cap mounted to an end of the body and including a protrusion abutting the first shoulder of the body and the first stop of the ratchet member, with the protrusion including a through-hole aligned with the driving hole of the ratchet member, with the second stop of the ratchet member abutting the second shoulder of the body.

14. The ratchet device as claimed in claim 13, with the through-hole formed in an end of the cap, with the cap further including another end having a peg, with the peg adapted to be fixed to a handle.

15. The ratchet device as claimed in claim 14, with the cap further including two abutment portions on opposite sides of the peg, with the handle including two ribs, with the abutment portions adapted to abut the ribs.

* * * * *